US008736529B2

(12) United States Patent
Chen et al.

(10) Patent No.: US 8,736,529 B2
(45) Date of Patent: May 27, 2014

(54) METHOD AND APPARATUS FOR GENERATING AN OVERDRIVE SIGNAL FOR A LIQUID CRYSTAL DISPLAY

(75) Inventors: Jiunn-Kuang Chen, Taoyuan County (TW); Yun-Hung Shen, Hsinchu (TW); Steve Wiyi Yang, Chu-Pai Hsinchu Hsien (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 934 days.

(21) Appl. No.: 12/068,618

(22) Filed: Feb. 8, 2008

(65) Prior Publication Data

US 2008/0231618 A1 Sep. 25, 2008

Related U.S. Application Data

(60) Provisional application No. 60/896,264, filed on Mar. 21, 2007.

(51) Int. Cl.
*G09G 3/36* (2006.01)

(52) U.S. Cl.
USPC ..... 345/94; 345/208

(58) Field of Classification Search
USPC ..... 345/87–104, 204–215, 690–699
See application file for complete search history.

(56) References Cited

U.S. PATENT DOCUMENTS

| | | | | |
|---|---|---|---|---|
| 2004/0263495 | A1* | 12/2004 | Sugino et al. | 345/204 |
| 2005/0068343 | A1* | 3/2005 | Pan et al. | 345/690 |
| 2005/0225522 | A1* | 10/2005 | Wu et al. | 345/87 |
| 2005/0248593 | A1* | 11/2005 | Feng et al. | 345/690 |
| 2006/0028492 | A1* | 2/2006 | Yamaguchi et al. | 345/690 |
| 2006/0227249 | A1* | 10/2006 | Chen et al. | 348/631 |
| 2007/0126678 | A1* | 6/2007 | Shih et al. | 345/89 |
| 2007/0159425 | A1* | 7/2007 | Knepper et al. | 345/87 |
| 2008/0106544 | A1* | 5/2008 | Lee et al. | 345/214 |
| 2008/0158119 | A1* | 7/2008 | Park et al. | 345/87 |
| 2008/0259059 | A1* | 10/2008 | De Greef | 345/204 |
| 2010/0188382 | A1* | 7/2010 | Chen et al. | 345/211 |
| 2010/0207939 | A1* | 8/2010 | Chen et al. | 345/419 |
| 2010/0214330 | A1* | 8/2010 | Shishido et al. | 345/691 |
| 2010/0283792 | A1* | 11/2010 | Chen et al. | 345/544 |
| 2012/0001951 | A1* | 1/2012 | Katagawa | 345/690 |
| 2013/0050170 | A1* | 2/2013 | Kimoto | 345/211 |

FOREIGN PATENT DOCUMENTS

| | | |
|---|---|---|
| CN | 1691122 A | 4/2004 |
| TW | I236650 | 7/2005 |
| TW | 200530993 | 9/2005 |

* cited by examiner

*Primary Examiner* — Gene W Lee
(74) *Attorney, Agent, or Firm* — Rabin & Berdo, P.C.

(57) ABSTRACT

An overdriving apparatus is provided in the invention. The apparatus includes a receiving module, a storing module, a dynamic information generating module, and an image driving module. The receiving module receives image data relative to an image signal. The storing module is used for storing the image data. Based on the image data, the dynamic information generating module generates dynamic information corresponding to a current image. The image driving module then generates an overdriving signal and/or a standard driving signal, according to the dynamic information and the image data, to drive a display.

15 Claims, 10 Drawing Sheets

METHOD AND APPARATUS FOR GENERATING AN OVERDRIVE SIGNAL FOR A LIQUID CRYSTAL DISPLAY

CROSS-REFERENCE TO RELATED APPLICATION(S)

This is a non-provisional application, which claims priority of provisional application 60/896,264, with a filing date of Mar. 21, 2007, the subject matter of which is incorporated herein by reference.

BACKGROUND OF THE INVENTION

1. Field of the Invention

The present invention relates to displays and, in particular, to methods and apparatuses for overdriving displays.

2. Description of the Prior Art

The reaction time is a critical factor for evaluating the quality of a liquid crystal display (LCD). Typically, the reaction time is inversely proportional to the clearness and smoothness of a motion picture displayed by the LCD. Whether an LCD can smoothly display dynamic images is especially important when users are watching movies or playing games. If the rotating speed of liquid crystal molecules lags behind a theoretically required speed, undesired motion tailings will be caused and will greatly affect the enjoyment of the users.

To improve the quality of LCDs, how to raise the switching speed of liquid crystal molecules is a highly concerned issue. Besides improving the physical characteristic of liquid crystal molecules, overdriving is also a technique for reducing the reaction time.

As known by those skilled in this art, overdriving provides liquid crystal molecules with a voltage higher or lower than a normal rated voltage, so as to reduce the time needed for rotating liquid crystal molecules to specific angles. In other words, the driving circuit in an LCD drives a liquid crystal molecule with a voltage higher or lower than a normal rated voltage. After the liquid crystal molecule is approximately rotated to the specific angle, the driving circuit will drive the liquid crystal molecule with the normal rated voltage corresponding to the specific angle.

Please refer to FIG. 1, which illustrates the block diagram of a display and a conventional driving circuit. The driving circuit 10 includes a receiving module 12, a storage module 14, and a driving module 16. In actual applications, the driving circuit 10 may be built in the display 80.

The receiving module 12 is used for receiving image data provided by other electronic devices (e.g. computers). The storage module 14 is used for temporarily storing the received image data. The driving module 16 generates driving signals for driving the display 80 based on the image data stored in the storage module 14. More specifically, the driving module 16 determines driving voltages for controlling liquid crystal molecules based on corresponding gray scales of pixels.

When an overdriving technique is adopted, the driving module 16 must further determine overdriving voltages for the liquid crystal molecules. The drawback of prior arts is that the driving module 16 is designed to process all regions in every image. Therefore, overdriving process in the driving circuit 10 usually takes much time and hardware resources.

SUMMARY OF THE INVENTION

To solve the aforementioned problem, the invention provides overdriving apparatuses and overdriving methods. The apparatuses and methods, according to the invention, perform overdriving mainly on the dynamic regions with larger variations instead of every region in every image. Therefore, processing time and hardware resources can be substantially retrenched.

The first embodiment, according to the invention, is an overdriving apparatus. The overdriving apparatus includes a receiving module, a storage module, a dynamic information generating module, and an image driving module. The receiving module is used for receiving image data corresponding to an image signal. The storage module then stores the received image data. The dynamic information generating module is coupled to the storage module and is used for generating dynamic information corresponding to a current image based on the image data. Based on the dynamic information and the image data, the image driving module generates an overdriving signal and/or a standard driving signal to drive a display.

The second embodiment, according to the invention, is another overdriving apparatus. The overdriving apparatus includes a receiving module, a storage module, and an image driving module. The receiving module is used for receiving image data corresponding to an image signal and dynamic information corresponding to a current image. The storage module then stores the image data. Based on the dynamic information and the image data, the image driving module generates an overdriving signal and/or a standard driving signal to drive a display.

The third embodiment, according to the invention, is an overdriving method. In the method, image data corresponding to an image signal is first received and stored. Subsequently, based on the image data, dynamic information corresponding to a current image is generated. Then, based on the dynamic information and the image data, an overdriving signal and/or a standard driving signal are generated to drive a display.

The fourth embodiment, according to the invention, is another overdriving method. In the method, image data corresponding to an image signal and dynamic information corresponding to a current image are first received. The image data is then stored. Based on the dynamic information and the image data, an overdriving signal and/or a standard driving signal are generated to drive a display.

The advantage and spirit of the invention may be understood by the following recitations together with the appended drawings.

BRIEF DESCRIPTION OF THE APPENDED DRAWINGS

Figure 3A:
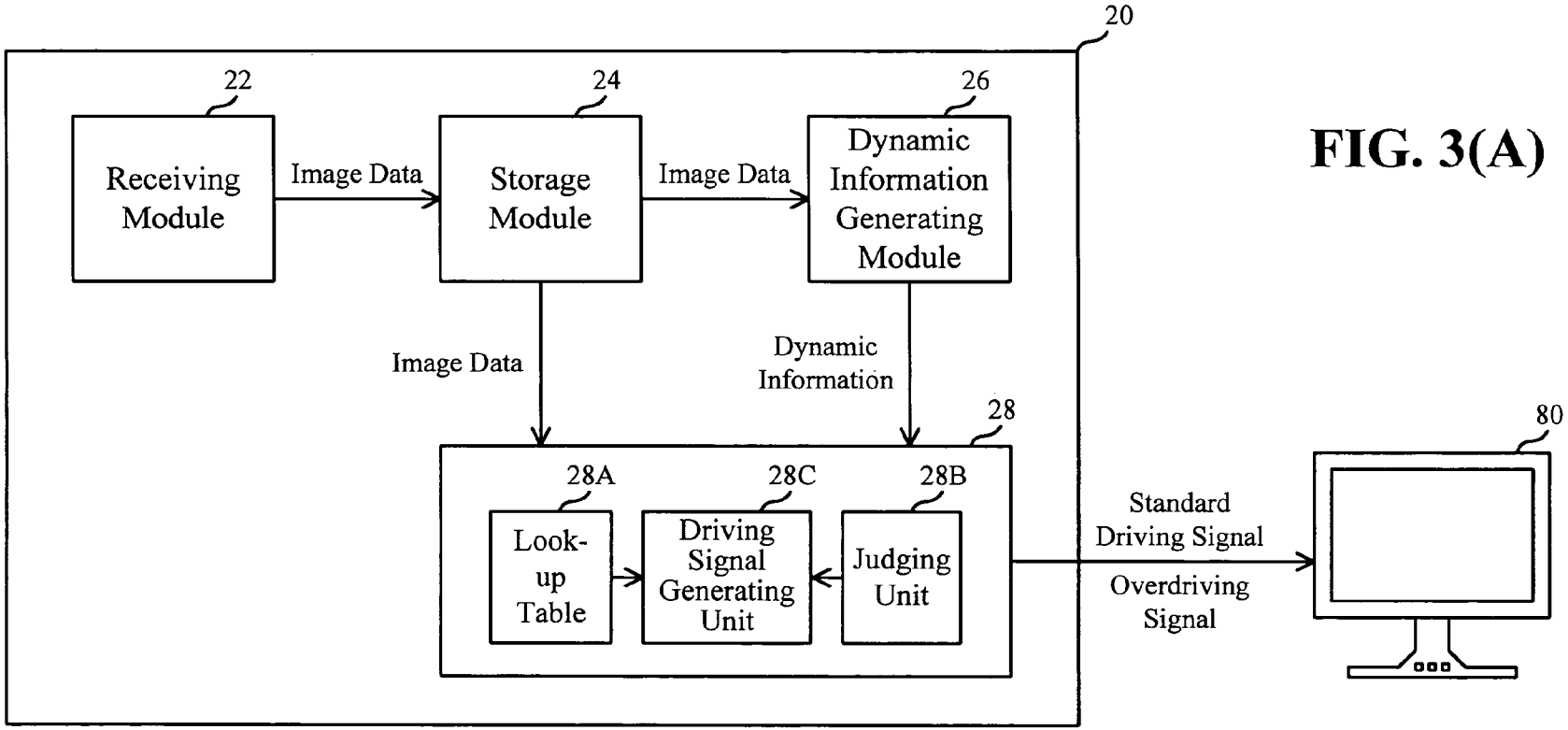
Figure 3B:
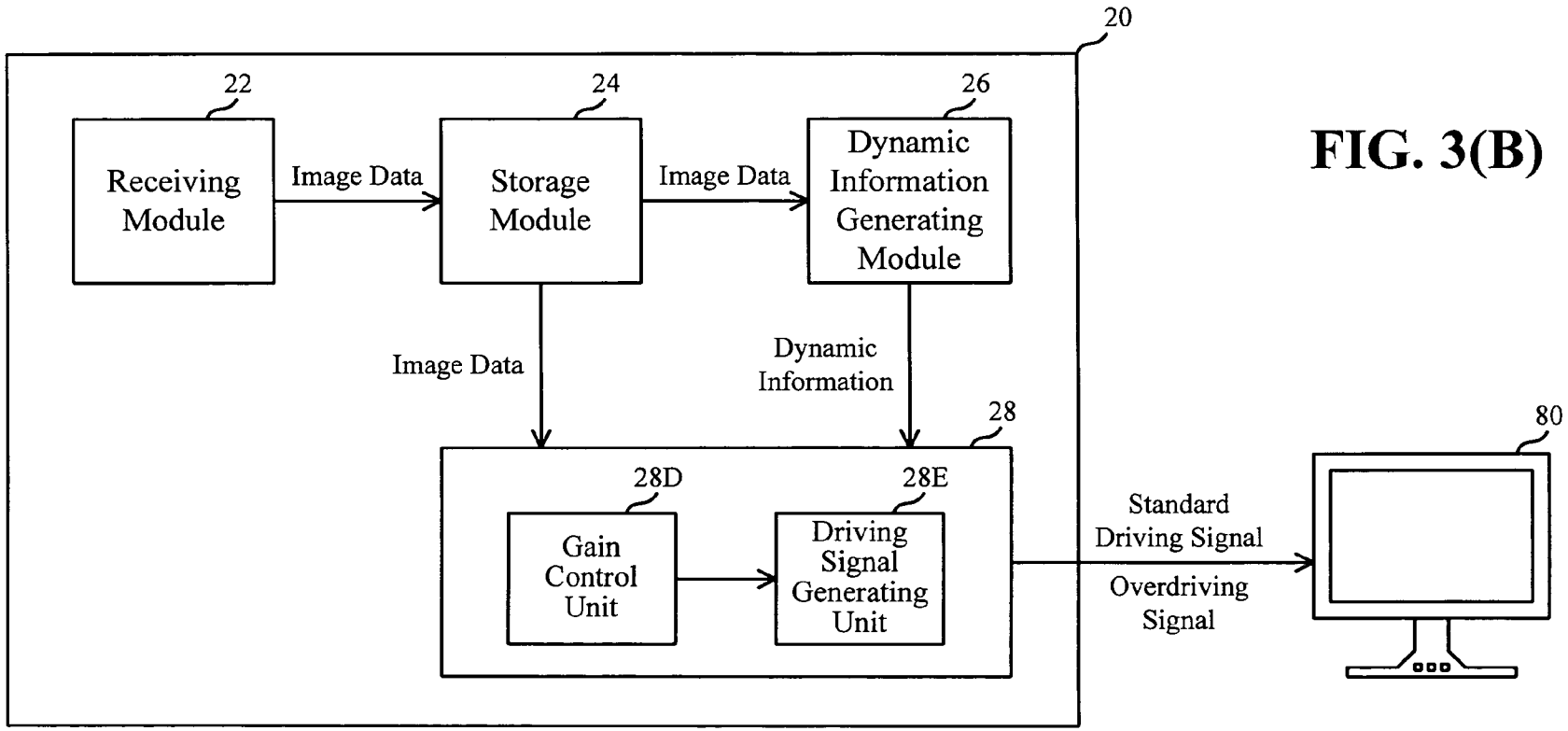

FIG. 3(A) and FIG. 3(B) illustrate detailed examples of the image driving module according to the invention.

Figure 4A:
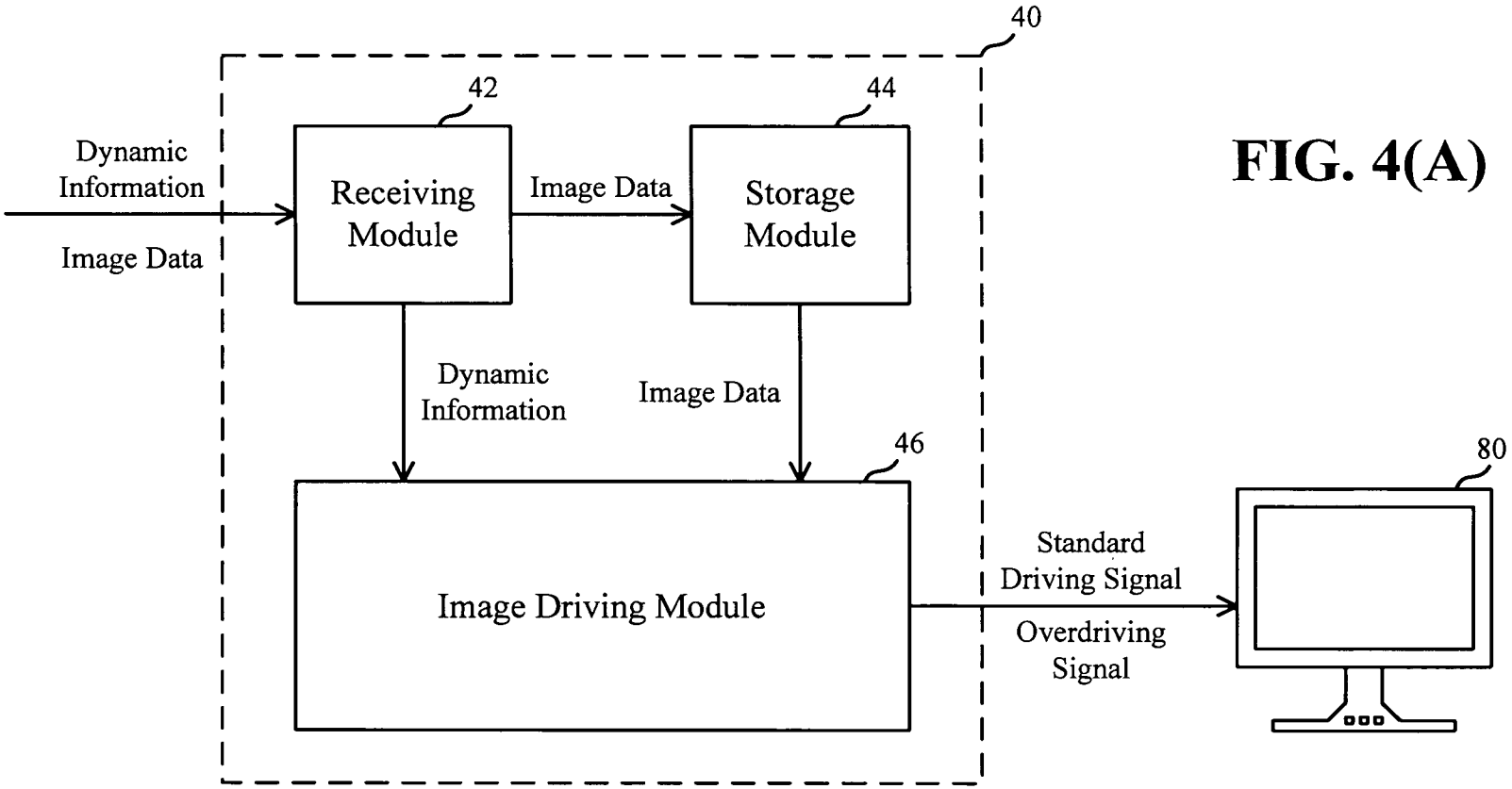

FIG. 4(A) illustrates the block diagram of the overdriving apparatus in the second embodiment according to the invention.

Figure 4B:
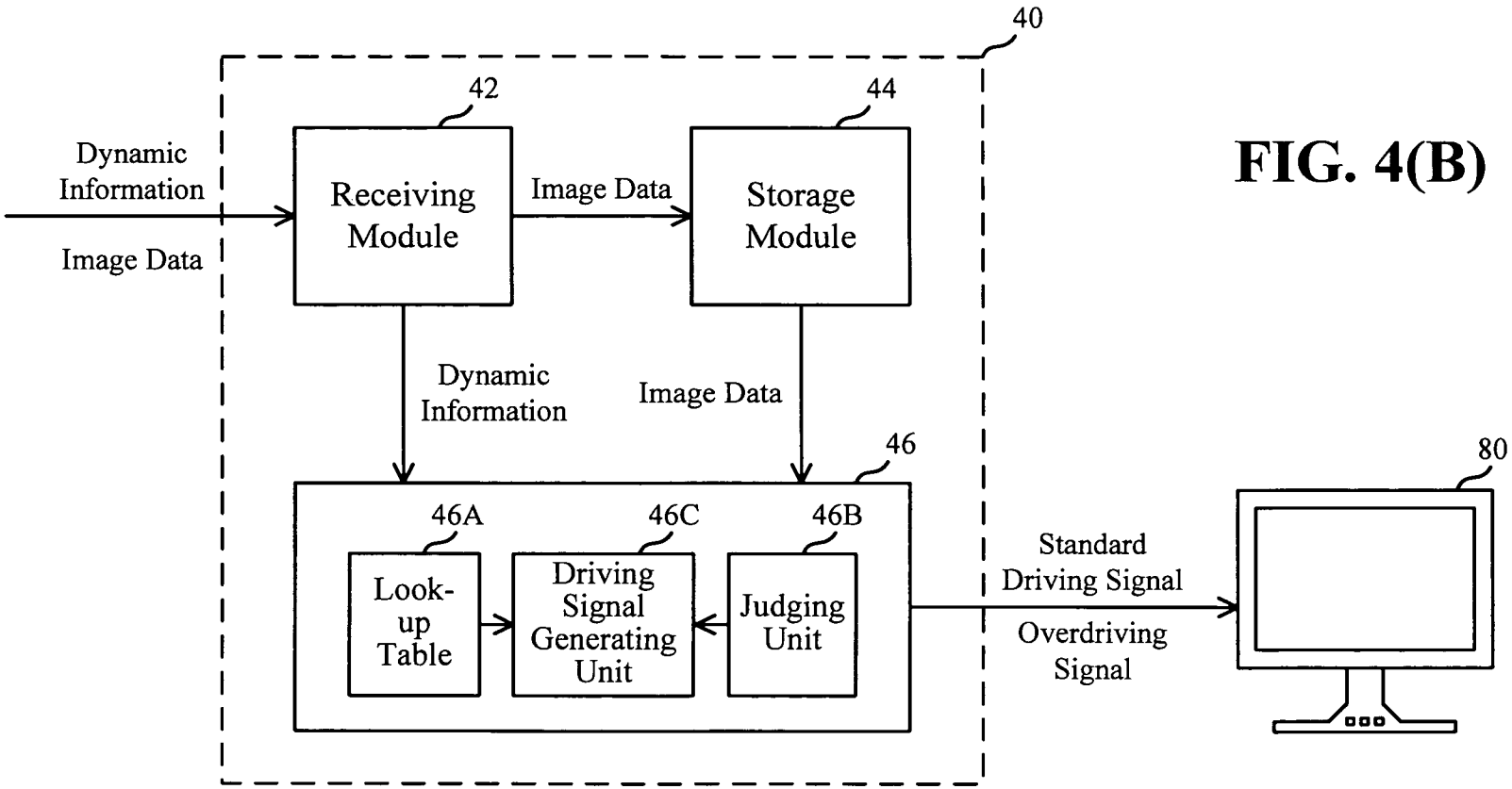

FIG. 4(B) illustrates a detailed example of the image driving module according to the invention.

Figure 5A:
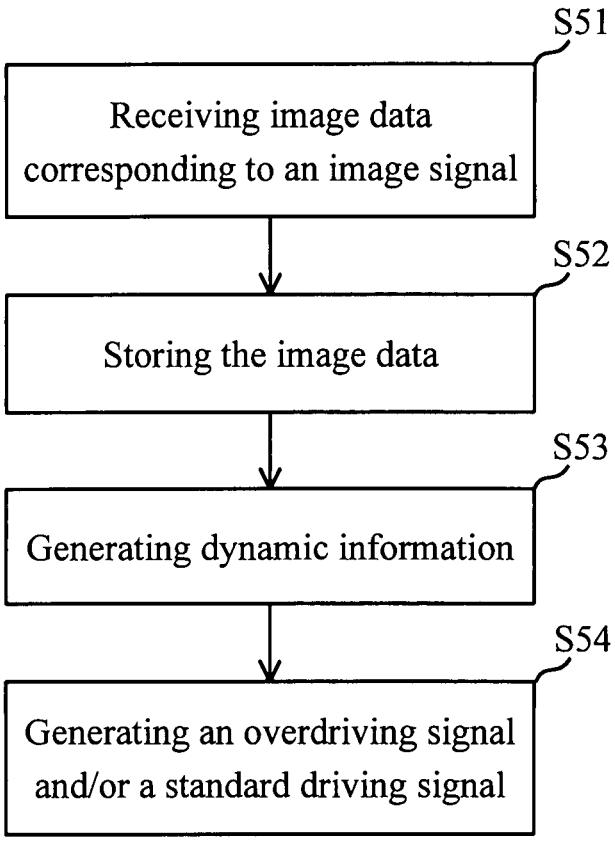

FIG. 5(A) illustrates the flowchart of the overdriving method in the third embodiment according to the invention.

Figure 5B:
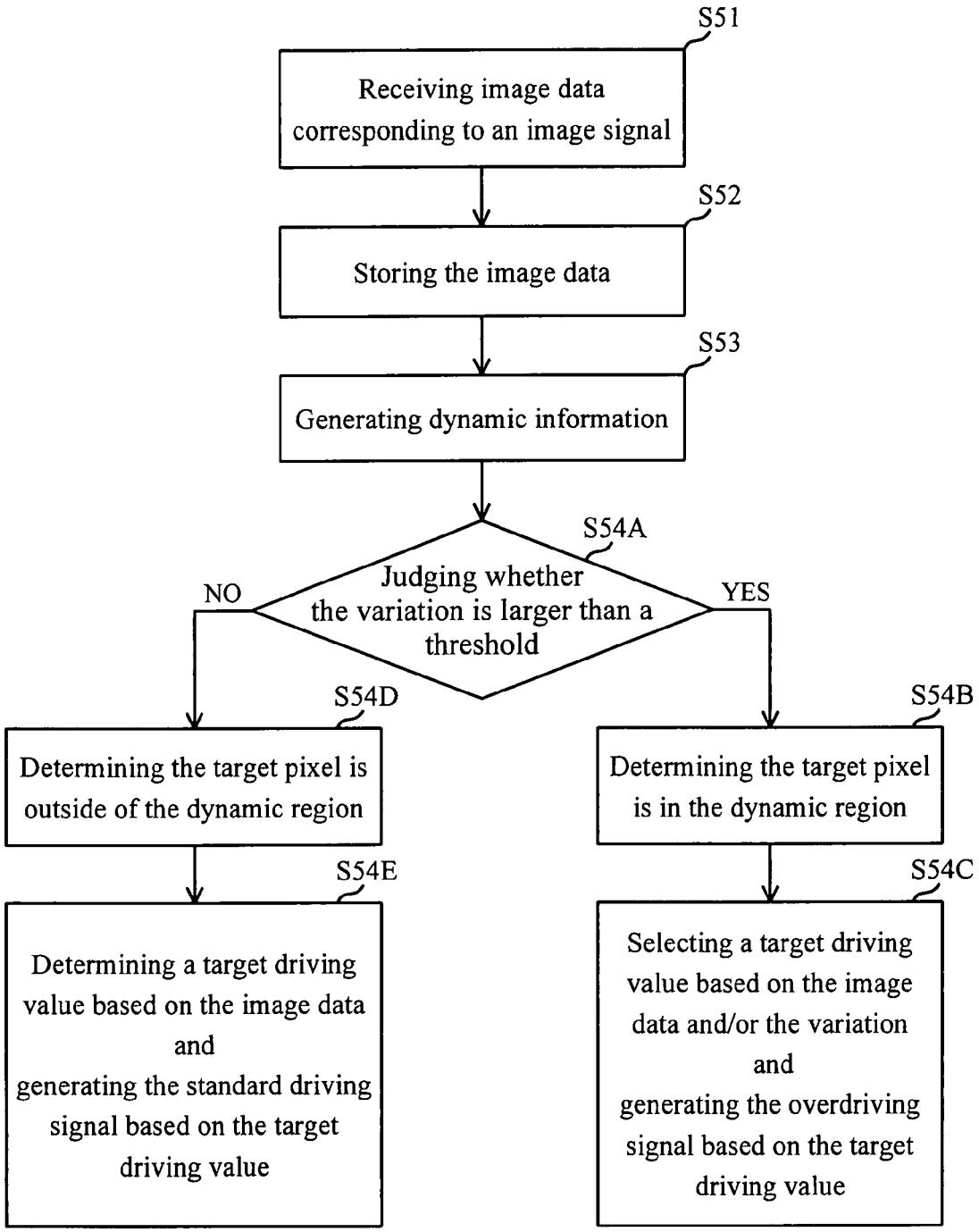
Figure 5C:
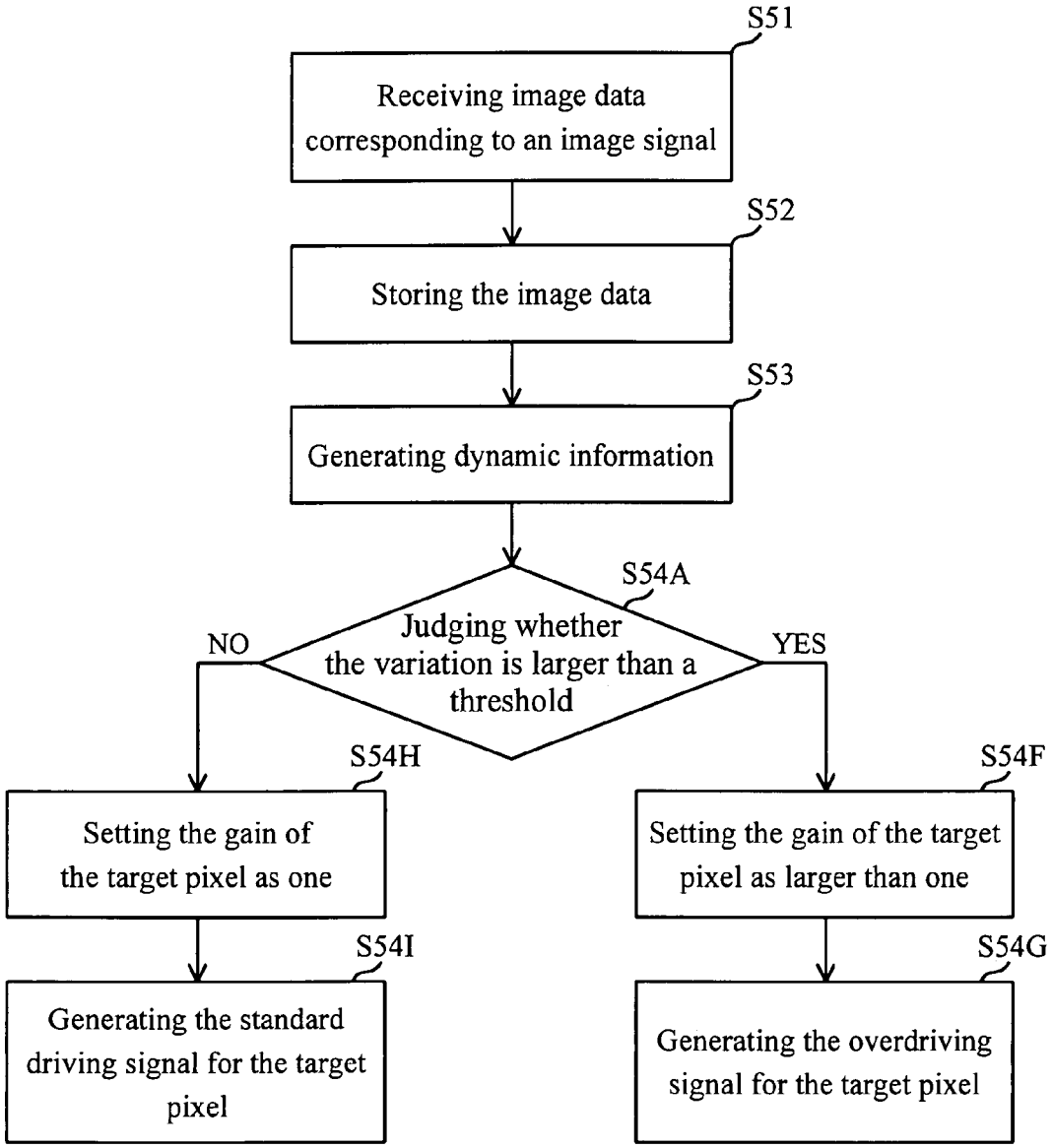

FIG. 5(B) and FIG. 5(C) illustrate detailed examples of step S54.

Figure 6:
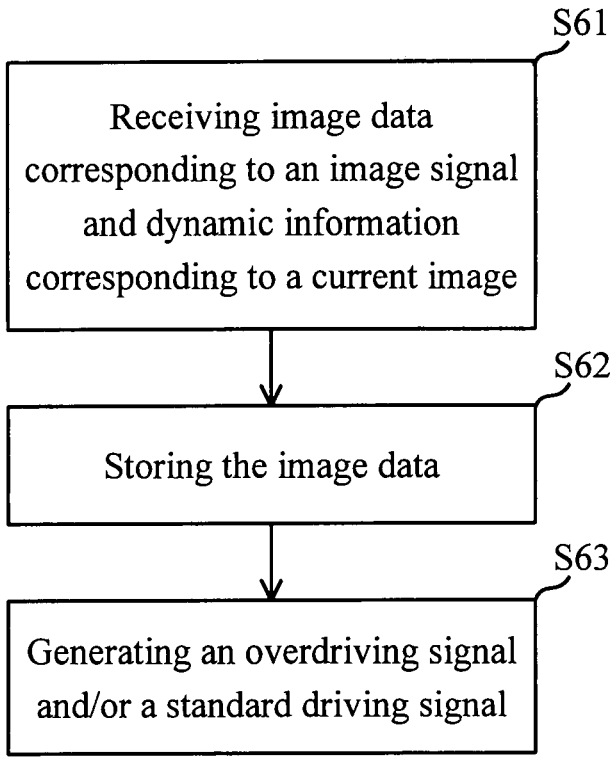

FIG. 6 illustrates the flowchart of the overdriving method in the fourth embodiment according to the invention.

DETAILED DESCRIPTION OF THE INVENTION

Figure 1:
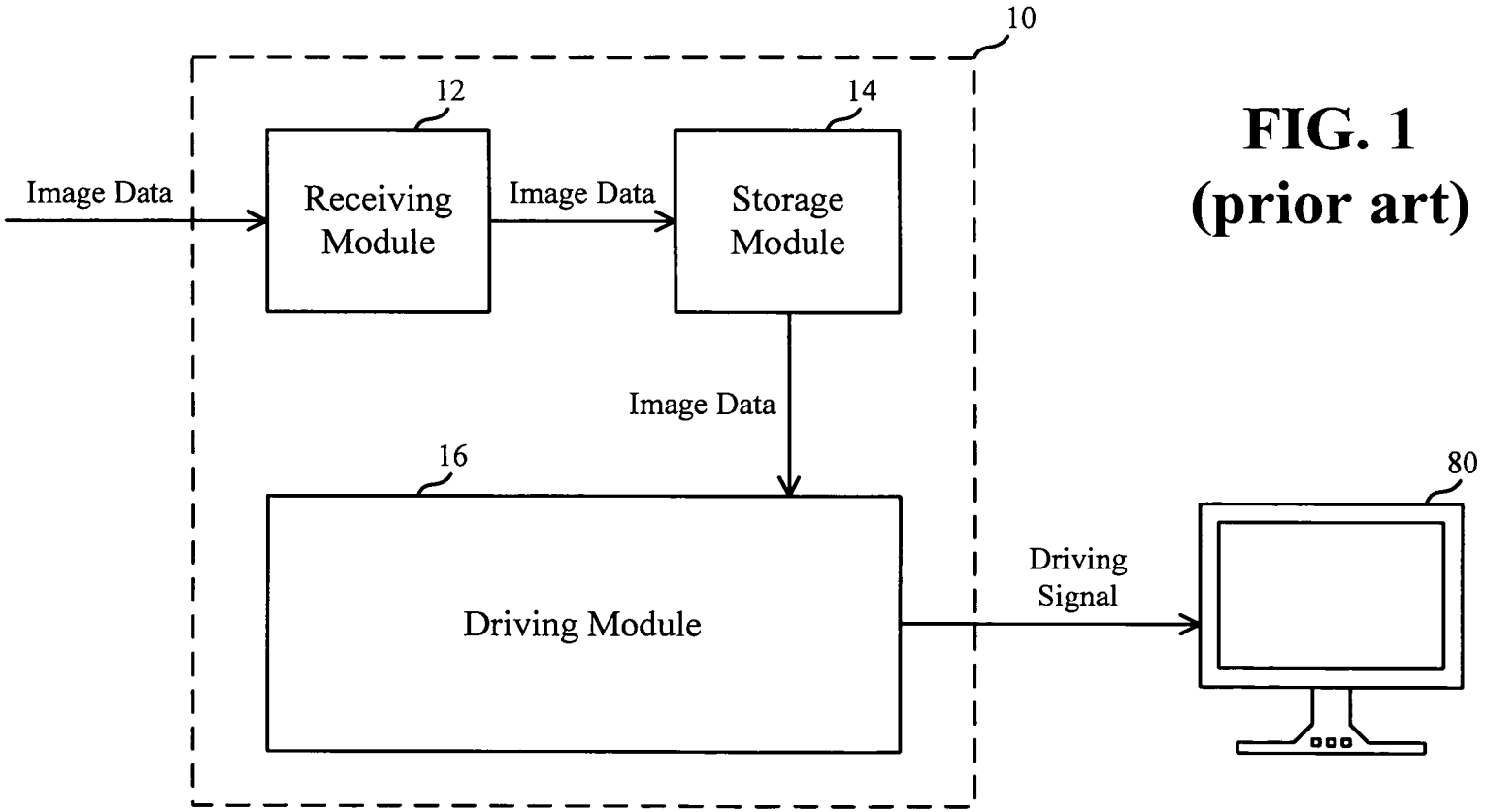
FIG. 1 (prior art)
FIG. 1 illustrates the block diagram of a display and a conventional driving circuit.
Figure 2:
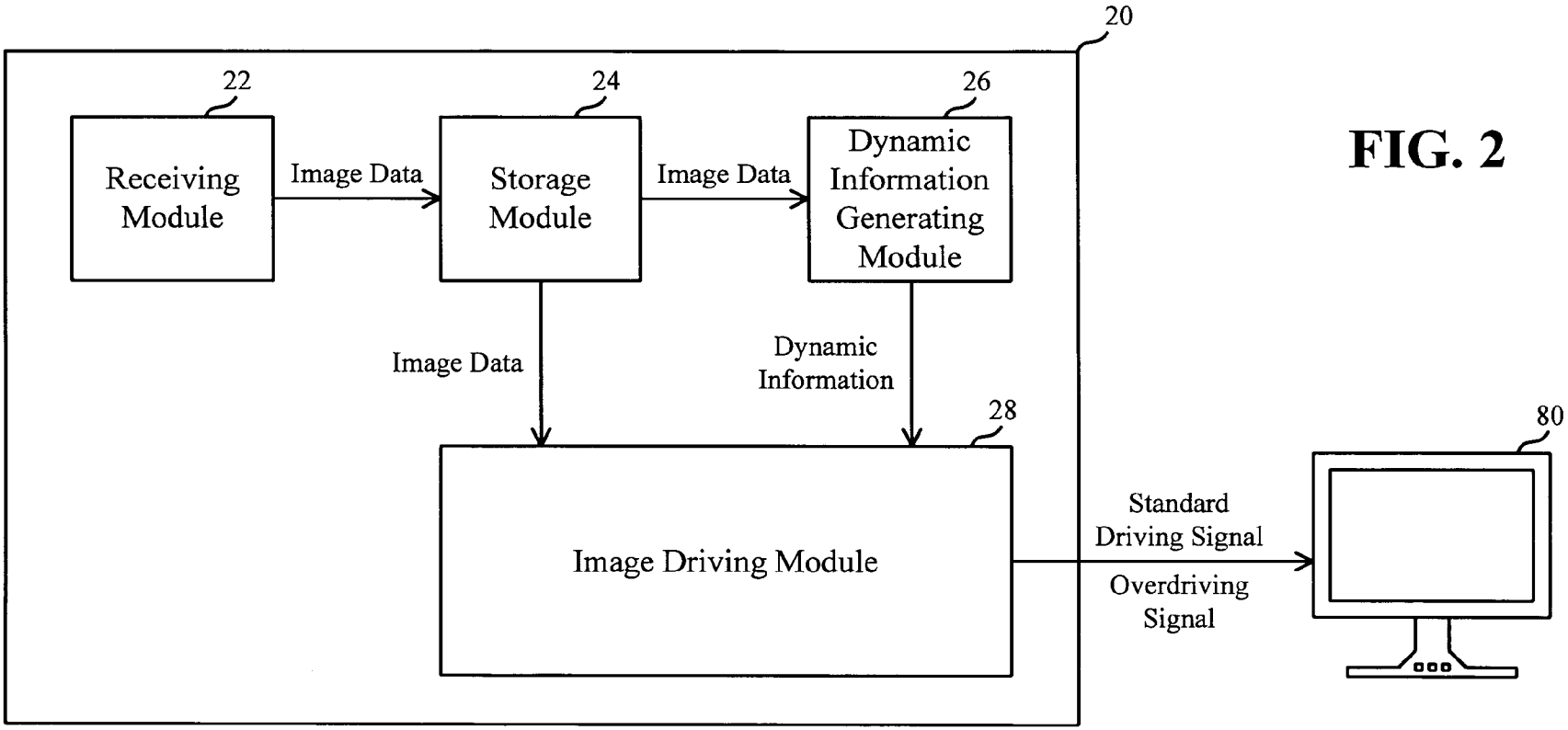
FIG. 2 illustrates the block diagram of the overdriving apparatus in the first embodiment according to the invention.

The first embodiment, according to the invention, is an overdriving apparatus. FIG. 2 illustrates the block diagram of this apparatus. As shown in FIG. 2, the overdriving apparatus 20 includes a receiving module 22, a storage module 24, a dynamic information generating module 26, and an image driving module 28.

The receiving module 22 is used for receiving image data corresponding to an image signal. The storage module 24 then stores the received image data. The dynamic information generating module 26 is coupled to the storage module 24 and is used for generating dynamic information corresponding to a current image based on the image data. The image driving module 28 is coupled to the storage module 24 and the dynamic information generating module 26. Based on the dynamic information and the image data, the image driving module 28 generates an overdriving signal and/or a standard driving signal to drive a display 80. In actual applications, the overdriving apparatus 20 may be built in the display 80, and the display 80 may be an LCD.

According to the invention, if the current image includes a dynamic region (e.g. a window therein a motion picture is displayed), the dynamic information can include position information of the dynamic region. Based on the position information, the image driving module 28 can generate overdriving signals only for the dynamic region and generate standard driving signals for other regions in the current image.

If some regions in adjacent images have only tiny variations or even are unchanged, these regions can be seen as static regions. According to the invention, overdriving will not be performed on these regions. Thereby, the image driving module 28 can use less time and resources for generating standard driving signals for these static regions.

Generally, the difference in gray levels of the same region in adjacent images is the basis for judging whether a region is dynamic or static. Therefore, during the process of generating the aforementioned dynamic information, perhaps the dynamic information generating module 26 has already calculated the differences of gray levels corresponding to a region (i.e. the variation of each pixel in the region).

If the dynamic information provided by the dynamic information generating module 26 only includes the position information of a dynamic region but not the variation of pixels, the image driving module 28 can first calculate the variations of pixels in the dynamic region and then find out the overdriving voltage corresponding to each pixel of the dynamic region by inspecting a look-up table based on the variations and/or image data.

In some applications, the dynamic information provided by the dynamic information generating module 26 may only include the variations of pixels but no position information of a dynamic region. Under this condition, the image driving module 28 can determine which regions are dynamic based on the variations. Then, the image driving module 28 generates overdriving signals for dynamic regions and standard driving signals for other regions in the current image.

FIG. 3(A) illustrates a detailed example of the image driving module 28. As shown in FIG. 3(A), the image driving module 28 can include a look-up table 28A, a judging unit 28B, and a driving signal generating unit 28C. If the dynamic information includes a variation relative to a target pixel in the current image, the judging unit 28B can be used for judging whether the variation is larger than a threshold. If the variation is larger than the threshold, the judging unit 28B determines that the target pixel is in a dynamic region. On the contrary, if the variation is smaller than the threshold, the judging unit 28B determines that the target pixel is not in a dynamic region.

At least one default driving value is stored in the look-up table 28A. The driving signal generating unit 28C is coupled to the look-up table 28A, the judging unit 28B, and the storage module 24. If the target pixel is in a dynamic region, the driving signal generating unit 28C can select a target driving value from the at least one default driving value in the lookup table 29A based on the degree of variation and/or the image data, and then it generates an overdriving signal for the target pixel based on the target driving value.

On the contrary, if the target pixel is outside the dynamic region, the driving signal generating unit 28C does not need to inspect the look-up table 28A. Instead, the driving signal generating unit 28C can directly determine a target driving value based on the degree of variation and/or the image data, and then it generates a standard driving signal for the target pixel based on the target driving value.

In actual applications, the dynamic information provided by the dynamic information generating module 26 may simultaneously include the location information of a dynamic region and its corresponding variations. Under this condition, the image driving module 28 does not need to judge which region is dynamic. Instead, the image driving module 28 can directly find out the overdriving voltage corresponding to each pixel in the dynamic region by inspecting a look-up table based on the image data and/or variations corresponding to the dynamic region.

Please refer to FIG. 3(B), which illustrates another detailed example of the image driving module 28. In this example, the image driving module 28 includes a gain control unit 28D and a driving signal generating unit 28E.

The gain control unit 28D is used for generating a gain for a target pixel in the current image based on the dynamic information provided by the dynamic information generating module 26. The driving signal generating unit 28E is coupled to the gain control unit 28D and the storage module 24. Based on the gain generated by the gain control unit 28D and the image data stored in the storage module 24, the driving signal generating unit 28E generates the overdriving signal and/or the standard driving signal for the target pixel.

When the dynamic information provided by the dynamic information generating module 26 only includes the position information of a dynamic region, the gain control unit 28D can first calculate the variations of the target pixels in the dynamic region based on the image data stored in the storage module 24. However, when the dynamic information includes the location information and the variations or just the variations, the gain control unit 28D does not need to re-calculate the variations of the target pixel according to the image data. If the variation of a target pixel is smaller than a threshold, it implies that the target pixel is outside the dynamic region. Then, the gain control unit 28D can set the gain of the target pixel as 1 and the driving signal generating unit 28E will generate a standard driving signal for the target pixel according to the gain and the image data.

On the contrary, if the variation of the target pixel is larger than the threshold, it implies that the target pixel is in the dynamic region. Then, the gain control unit 28D can set the gain of the target pixel as any number larger than 1 and the driving signal generating unit 28E will generate an overdriving signal for the target pixel.

Please refer to FIG. 4(A), which illustrates the block diagram of the overdriving apparatus in the second embodiment according to the invention. The overdriving apparatus 40 includes a receiving module 42, a storage module 44, and an image driving module 46. As shown in 4(A), the receiving module 42 is used for receiving image data corresponding to an image signal and dynamic information corresponding to a current image. The storage module 44 is coupled to the receiving module 42 and is used for storing the image data. The image driving module 46 is coupled to the receiving module 42 and the storage module 44. Based on the dynamic information and the image data, the image driving module 46 generates an overdriving signal and/or a standard driving signal to drive a display 80. The overdriving apparatus 40 may be built in the display 80.

In actual applications, there are some video apparatuses conforming to new standards that can directly provide position information relative to displayed widows/applications. For instance, the image data and dynamic information may be transmitted to the receiving module 42 via a digital video interface (DVI) or a display data channel command interface (DDCCI).

In this embodiment, the dynamic information has already included the position information of dynamic regions. Based on this dynamic information, the image driving module 46 generates overdriving signals for dynamic regions and standard driving signals for the other regions in the current image.

Please refer to FIG. 4(B), which illustrates a detailed embodiment of the image driving module 46. In this example, the image driving module 46 includes a look-up table 46A, a judging unit 46B, and a driving signal generating unit 46C.

In the look-up table 46A, at least one predetermined driving value is stored. The judging unit 46B is coupled to the receiving module 42 and is used for judging whether a target pixel is located in the dynamic region according to the dynamic information. The driving signal generating unit 46C is coupled to the look-up table 46A, the judging unit 46B, and the storage module 44. If the target pixel is located within the dynamic region, the driving signal generating unit 46C will select a target driving value from the at least one predetermined driving value based on the image data. An overdriving signal is then generated for the target pixel based on the target driving value.

On the contrary, if the target pixel is located outside the dynamic region, the driving signal generating unit 46C does not need to inspect the look-up table 46A and can directly determine the target driving value based on the image data. A standard driving signal is then generated for the target pixel based on the target driving value.

In actual applications, the structure of the image driving module 46 can be similar to that of the image driving module 28 in FIG. 3B. In other words, the image driving module 46 can selectively generate a standard driving signal or an overdriving signal by controlling the gains.

The third embodiment, according to the invention, is an overdriving method. FIG. 5(A) illustrates the flowchart of this method. As shown in FIG. 5(A), in step S5 1, image data corresponding to an image signal is received. In step S52, the image data is stored. In step S53, dynamic information corresponding to a current image is generated based on the image data. Then, in step S54, a standard driving signal and/or an overdriving signal are generated for the current image based on the image data and the dynamic information to drive a display.

In actual applications, the dynamic information can include the position information of a dynamic region in the current image. On the other hand, the position information of the dynamic region may also be generated based on the dynamic information in step S54. In step S54, based on the dynamic information, an overdriving signal is generated for a dynamic region, and a standard driving signal is generated for the other regions in the current image.

Please refer to FIG. 5(B), which illustrates a detailed example of step S54 under the condition when the dynamic information includes a variation of a target pixel in the current image. In this example, it is first judged whether the variation is larger than a threshold in step S54A. If the judging result of step S54A is YES, steps S54B and 54C will be performed. In step S54B, a target driving value is selected from at least one default driving value based on the image data and/or variation. In step S54C, the overdriving signal is generated for the target pixel based on the target driving value.

On the contrary, if the judging result of step S54A is NO, steps S54D and 54E will be performed. In step S54D, a target driving value is determined for the target pixel based on the image data. In step S54E, the standard driving signal for the target pixel is generated based on the target driving value.

Please refer to FIG. 5(C), which illustrates another detailed example of step S54 under the condition when the dynamic information includes a variation of a target pixel in the current image. In this example, it is also first judged whether the variation is larger than a threshold in step S54A. If the judging result of step S54A is YES, steps S54F and 54G will be performed. In step S54F, a gain of the target pixel is set as larger than 1. In step S54G, based on the gain and the image data, an overdriving signal is generated for the target pixel.

On the contrary, if the judging result of step S54A is NO, steps S54H and S54I are performed. A gain of the target pixel is set as 1. Based on the gain and the image data, a standard driving signal is then generated for the target pixel.

The fourth embodiment, according to the invention, is another overdriving method. FIG. 6 illustrates the flowchart of this method. In step S61, image data corresponding to an image signal and dynamic information corresponding to a current image are received. In step S62, the image data is stored. Then, in step S63, an overdriving signal and/or a standard driving signal to drive a display are generated based on the dynamic information and the image data.

Similarly, according to the dynamic information, it can be judged whether a target pixel is in a dynamic region. If the target pixel is in a dynamic region, in step S63, a target driving value can be selected from at least one default driving value based on the image data. Subsequently, an overdriving signal can be generated for the target pixel based on the target driving value. If the target pixel is outside a dynamic region, in step S63, a target driving value for the target pixel can be determined based on the image data. Subsequently, a standard driving signal can be generated for the target pixel based on the target driving value.

As described above, the apparatuses and methods, according to the invention, perform overdriving mainly on the dynamic regions with larger variations of image data instead of every region in every image. Therefore, compared with prior arts, processing time and hardware resources can be substantially retrenched in the invention.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An overdriving apparatus, comprising:

a receiving module for receiving image data corresponding to an image signal;

a storage module, coupled to the receiving module, for storing the image data;

a dynamic information generating module, coupled to the storage module, for generating dynamic information corresponding to a current image based on the image data, wherein the dynamic information includes position information that indicates a dynamic region corresponding to the current image and the dynamic region comprises a plurality of pixels and is smaller than the current image; and an image driving module, coupled to the storage module and the dynamic information generating module, for calculating variations of pixels only in the dynamic region indicated by the position information, and then determining an overdriving signal corresponding to each pixel of the dynamic region, the image driving module including:

a gain control unit coupled to the dynamic information generating module, which first calculates the variations based on the image data stored in the storage module, and then generates a gain for a target pixel based on the variations, and a driving signal generating unit, coupled to the gain control unit and the storage module, which generates the overdriving signal for the target pixel, based on the gain and the image data.

2. The overdriving apparatus of claim 1, wherein the image driving module generates the overdriving signal for the dynamic region and a standard driving signal for the other regions in the current image.

3. The overdriving apparatus of claim 1, wherein the image driving module determines the dynamic region in the current image based on the dynamic information, generates the overdriving signal for the dynamic region, and generates a standard driving signal for the other regions in the current image.

4. The overdriving apparatus of claim 1, wherein the driving signal generating unit generates standard driving signals for pixels outside the dynamic region.

5. An overdriving apparatus, comprising:

a receiving module for receiving image data corresponding to an image signal and dynamic information, wherein the dynamic information includes position information that indicates a dynamic region corresponding to a current image and the dynamic region comprises a plurality of pixels and is smaller than the current image;

a storage module, coupled to the receiving module, for storing the image data; and an image driving module, coupled to the receiving module and the storage module, for calculating variations of pixels only in the dynamic region indicated by the position information, and then determining an overdriving signal corresponding to each pixel of the dynamic region, the image driving module including:

a gain control unit, coupled to the dynamic information generating module, which first calculates the variations based on the image data stored in the storage module, and then generates a gain for a target pixel based on the variations, and a driving signal generating unit, coupled to the gain control unit and the storage module, which generates the overdriving signal for the target pixel, based on the gain and the image data.

6. The overdriving apparatus of claim 5, wherein the image driving module generates the overdriving signal for the dynamic region and generates a standard driving signal for the other regions in the current image.

7. The overdriving apparatus of claim 5, wherein the image data and the dynamic information are transmitted to the receiving module via a digital video interface (DVI) or a display data channel command interface (DDCCI) consistent with versions after DDCCI 1.0.

8. An overdriving method, comprising the steps of:

(a) receiving image data corresponding to an image signal;

(b) storing the image data;

(c) generating dynamic information corresponding to a current image based on the image data, wherein the dynamic information includes position information that indicates a dynamic region corresponding to the current image and the dynamic region comprises a plurality of pixels and is smaller than the current image; and (d) calculating variations of pixels only in the dynamic region indicated by the position information, and then determining an overdriving signal corresponding to each pixel of the dynamic region, wherein step (d) includes:

(d1) first calculating the variations based on the image data, and then generating a gain for a target pixel based on the variations, and (d2) generating the overdriving signal for the target pixel based on the gain and the image data.

9. The method of claim 8, wherein in step (d), the overdriving signal is generated for the dynamic region, and a standard driving signal is generated for the other regions in the current image.

10. The method of claim 8, wherein step (d) further comprises:

(d3) based on the dynamic information, determining the dynamic region in the current image;

(d4) generating the overdriving signal for the dynamic region; and (d5) generating a standard driving signal for the other regions in the current image.

11. The method of claim 10, wherein if a pixel is outside of the dynamic region, in step (d5), a target driving value is determined for the pixel based on the image data, and the standard driving signal is generated for the pixel based on the target driving value.

12. An overdriving method, comprising the steps of:

(a) receiving image data corresponding to an image signal and dynamic information, wherein the dynamic information includes position information that indicates a dynamic region corresponding to a current image and the dynamic region comprises a plurality of pixels and is smaller than the current image;

(b) storing the image data; and (c) calculating variations of pixels only in the dynamic region indicated by the position information, and then determining an overdriving signal corresponding to each pixel of the dynamic region, wherein step (c) includes:

(c1) first calculating the variations based on the image data, and then generating a gain for a target pixel based on the variations, and (c2) generating the overdriving signal for the target pixel based on the gain and the image data.

13. The method of claim 12, wherein in step (c), a standard driving signal is generated for the other regions in the current image.

14. The method of claim 13, wherein step (c) further comprises:

(c3) determining a target driving value for a pixel outside the dynamic region based on the image data and then generating the standard driving signal for the pixel based on the target driving value.

15. The method of claim 12, wherein in step (a), the image data and the dynamic information are received via a digital video interface (DVI) or a display data channel command interface (DDCCI) consistent with versions after DDCCI 1.0.

* * * * *